US007367149B2

(12) United States Patent
Fast et al.

(10) Patent No.: US 7,367,149 B2
(45) Date of Patent: May 6, 2008

(54) LABEL HOLDER

(75) Inventors: Jacob Fast, Boca Raton, FL (US); Michael G. Lowry, Boca Raton, FL (US)

(73) Assignee: Fast Industries, Ltd, Fort Lauderdale, FL (US)

( * ) Notice: Subject to any disclaimer, the term of this patent is extended or adjusted under 35 U.S.C. 154(b) by 405 days.

(21) Appl. No.: 10/959,436

(22) Filed: Oct. 7, 2004

(65) Prior Publication Data

US 2005/0076554 A1 Apr. 14, 2005

Related U.S. Application Data

(60) Provisional application No. 60/510,131, filed on Oct. 14, 2003.

(51) Int. Cl.
*G09F 3/18* (2006.01)

(52) U.S. Cl. ..... 40/649; 40/658; 40/666

(58) Field of Classification Search ..... 40/649, 40/658, 666
See application file for complete search history.

(56) References Cited

U.S. PATENT DOCUMENTS 4,539,766 A 9/1985 Fast
4,557,064 A 12/1985 Thompson
4,625,441 A 12/1986 Fast
4,716,669 A 1/1988 Fast
4,760,660 A 8/1988 Fast
4,761,904 A 8/1988 Fast
4,866,868 A * 9/1989 Kass ..... 40/661
4,869,007 A 9/1989 Fast
5,044,104 A * 9/1991 Hopperdietzel ..... 40/654.01
5,263,269 A * 11/1993 Tjarnlund ..... 40/5
5,394,632 A 3/1995 Gebka
5,458,307 A 10/1995 Gebka
5,488,793 A 2/1996 Gebka
5,515,632 A 5/1996 Gebka
5,678,699 A 10/1997 Gebka
5,682,698 A 11/1997 Bevins
5,826,359 A * 10/1998 Thalenfeld et al. ..... 40/642.01
5,863,019 A * 1/1999 Rose et al. ..... 248/205.3
5,899,011 A 5/1999 Brinkman
6,163,996 A 12/2000 Gebka
6,286,694 B1 * 9/2001 Battaglia et al. ..... 211/187
6,470,613 B1 * 10/2002 Wildrick ..... 40/661.03
6,553,702 B1 * 4/2003 Bacnik ..... 40/661.03
6,889,855 B2 * 5/2005 Nagel ..... 211/59.3
6,935,062 B2 * 8/2005 Lowry et al. ..... 40/661.03
6,971,201 B2 * 12/2005 Brinkman et al. ..... 40/642.02

FOREIGN PATENT DOCUMENTS

NL 1016057 5/2002
WO WO 93/19448 9/1993

* cited by examiner

*Primary Examiner*—Christopher P. Ellis
*Assistant Examiner*—Brian Swenson
(74) *Attorney, Agent, or Firm*—Jacobson Holman PLLC

(57) ABSTRACT

Label holders adapted to be mounted on a supporting surface formed of a grid of wire rods, such as a wire basket, a wire rack, a wire shelf or the like. The label holder includes a planar backing element supporting the label holder portion for viewing at a preselected angle, with a trapezoidal connector formed in the backing element to snappingly engage over a horizontally extending wire rod of the grid. The trapezoidal connector may include a plurality of flexible bumps or ridges for enhanced gripping of the wire rods of the grid. The remainder of the backing element rests against the vertically extending wire rods of the grid.

13 Claims, 7 Drawing Sheets

LABEL HOLDER

This is a complete application claiming priority and benefit of provisional application Ser. No. 60/510,131 filed Oct. 14, 2003.

BACKGROUND OF THE INVENTION

1. Field of the Invention

This invention relates to label holders and relates more particularly to label holders adapted to be mounted on a supporting surface formed of wire, such as a wire basket, a wire rack, a wire shelf, or the like.

2. Description of the Related Art

Consumer-oriented product information labels are commonly found in supermarkets, drug stores, and other such stores and provide purchasers with the unit price, promotional and nutritional information, and the like and, also, commonly include bar codes or other inventory control information for the use of the store personnel. Such information may be carried on paper or plastic labels secured directly to the side of a shelf unit or the front edge of a merchandise shelf, but the use of adhesively-backed labels has obvious disadvantages in the constantly changing commercial environment found in today's marketplace. Oftentimes, the front edge of the merchandise shelf is provided with an integral C-channel or the like that can either carry the labels directly or, alternatively, carry plastic holders which are adapted to removably receive and display the labels in a well known manner. Label holders adapted for use in various environments will be seen in commonly assigned U.S. Pat. Nos. 4,625,441, 4,716,669, 5,458,307, 5,488,793, 5,515,632, 5,678,699, 5,682,698, 5,899,011 and 6,163,996, the subject matters of which are incorporated herein in their entirety by reference ("the label holder patents"). These patents are cited merely as exemplary to illustrate the many and varied forms such devices can take.

Combination label/sign holder have been developed wherein labels can be selectively inserted and removed from the label holder pocket without removing any of the sign holders associated with related products on a merchandising shelf. Such a construction is seen in U.S. Pat. No. 6,568,112 (the '112 patent), the disclosure of which is incorporated herein in its entirety by reference. The sign holder portion of the combination label/sign holder of the '112 patent is carried by, and moves with, the cover member of the label holder, avoiding interfering with access to the label holder pocket. This is accomplished by providing the front surface of the cover member of the label holder with a pair of sign holder-receiving lip members which can snappingly receive edge portions of a resilient plastic or metal sign holder such as seen in U.S. Pat. No. 5,394,632 (the '632 patent) or U.S. Pat. No. 5,488,793 (the '793 patent), or the engaging portions of a depending sign holder of the type seen in U.S. Pat. Nos. 5,682,698 and 6,163,996 (the '698 and '996 patents, respectively), the subject matters of all of which are incorporated herein by reference, or other such commercially available sign holders.

More recently, in place of, or in addition to, such paper or plastic information containing labels, electronic information carriers have been employed. Electronic shelf labels (ESLs) are generally integrated with the in-store processor (ISP) or a free-standing controller that communicates with file information supporting the store's point-of-sale system. The ESL system may include low-voltage communication electronics or communication base stations (CBS) located in store ceilings away from the store operations. The ESLs are positioned throughout the store to identify an item's retail price and other information of interest to the consumer or for use by the store's inventory system.

Price changes may be initiated through the store's controller which updates item price files. This information, which has an association to a particular product identified by item number or UPC code, is communicated to the CBS in the ceiling and transmitted via a high frequency radio signal to the corresponding ESL.

The ESLs are programmed with differing addresses that are also associated with the item number or UPC code of the product they represent. Once the addressed device is found, the label display changes and reflects an acknowledgment back to the CBS to confirm that the transmission was received and enacted. This acknowledgment is then communicated back to the ISP to complete the transaction.

These systems, such as produced by NCR under its DecisioNet™ trademark, allow the ESLs to be independent of wires and cables below the ceiling, which reduces installation time and cost. Since there are no wires or cables required from the ceiling down, the label is free to be positioned anywhere. When store shelf resets occur, ESLs move easily with the shelves.

These ESL units, however, much like paper labels, require a carrier device to facilitate supporting them at selected locations. One such carrier is described in commonly-assigned pending patent application Ser. No. 10/448,049 entitled "Label Holder for Electronic Labeling Devices", incorporated by reference herein.

When price channels are used as above for labeling merchandise on a shelf, no significant problems arise for shelves which are at a convenient viewing height for a customer. For shelves near floor level, and shelves above eye level, however, customers have trouble in reading price channel labels because the labels extend generally vertically in use.

For the most part, such label holders, whether they be designed for paper labels, plastic labels, a combination of labels and signs or flags, or even ESLs, have been designed for attachment to a C-channel or, perhaps, a merchandise display shelf devoid of a C-channel, or even the flat side of a shelf unit or the like. Specialized problems exist when the label holder is to be attached to a wire rod-type structure such as found in a wire basket, a wire rack, a wire shelf, or another merchandise display supporting surface formed of wire rod material or the like. One form of label holder adapted for use with such structures is seen in U.S. Pat. No. 4,760,660 (the '660 patent), the subject matter of which is incorporated herein in its entirety by reference. The label holder of the '660 patent is somewhat complicated to use and can only be secured over the top wire of a rod-type structure. Tabs which loop around generally horizontally extending wire rods forming part of a wire basket, wire rack, wire shelf or the like, are seen in U.S. Pat. Nos. 4,761,904 and 4,869,007 (the '904 and '007 patents, respectively), the subject matters of which are also incorporated herein in their entirety by reference. The designs of the '904 and '007 patents are somewhat fragile, relying on relatively thin portions of the label holder for support. Moreover, such label holders themselves can move or swing relative to the wire rod support making it difficult to read a bar code or the like and impossible to adjust the viewing angle of the labels carried thereby in the event the supporting rod is relatively high or relatively low relative to the eye of a passerby.

SUMMARY OF THE INVENTION

In view of the foregoing, it is a primary object of this invention to provide a highly versatile label holder for adhesive or non-adhesive paper or plastic labels, or label/sign combinations, or even electronic information labels, wherein the holder is particularly adapted to support such elements on a wire rod merchandise display, such as a wire basket, a wire rack or a wire shelf unit.

A further object of this invention is the provision of a label holder of the type described which easily snaps on or off a wire rod element of such a merchandise support and fixes the label holder in a selected orientation to facilitate viewing the information on labels carried thereby.

Yet another object of this invention is the provision of a label holder for a wire rod merchandise support which is simple and inexpensive to manufacture and easy to use.

Other and further objects, features and advantages of the invention will become apparent from the ensuing description and claims taken in conjunction with the attached drawings.

BRIEF DESCRIPTION OF THE DRAWINGS

These and other objects, features and many of the attendant advantages of the invention will be better understood upon a reading of the following detailed description when considered in connection with the accompanying drawings wherein.

Like reference characters refer to like parts throughout the several views of the drawings.

DETAILED DESCRIPTION OF THE PREFERRED EMBODIMENTS

Figure 1:
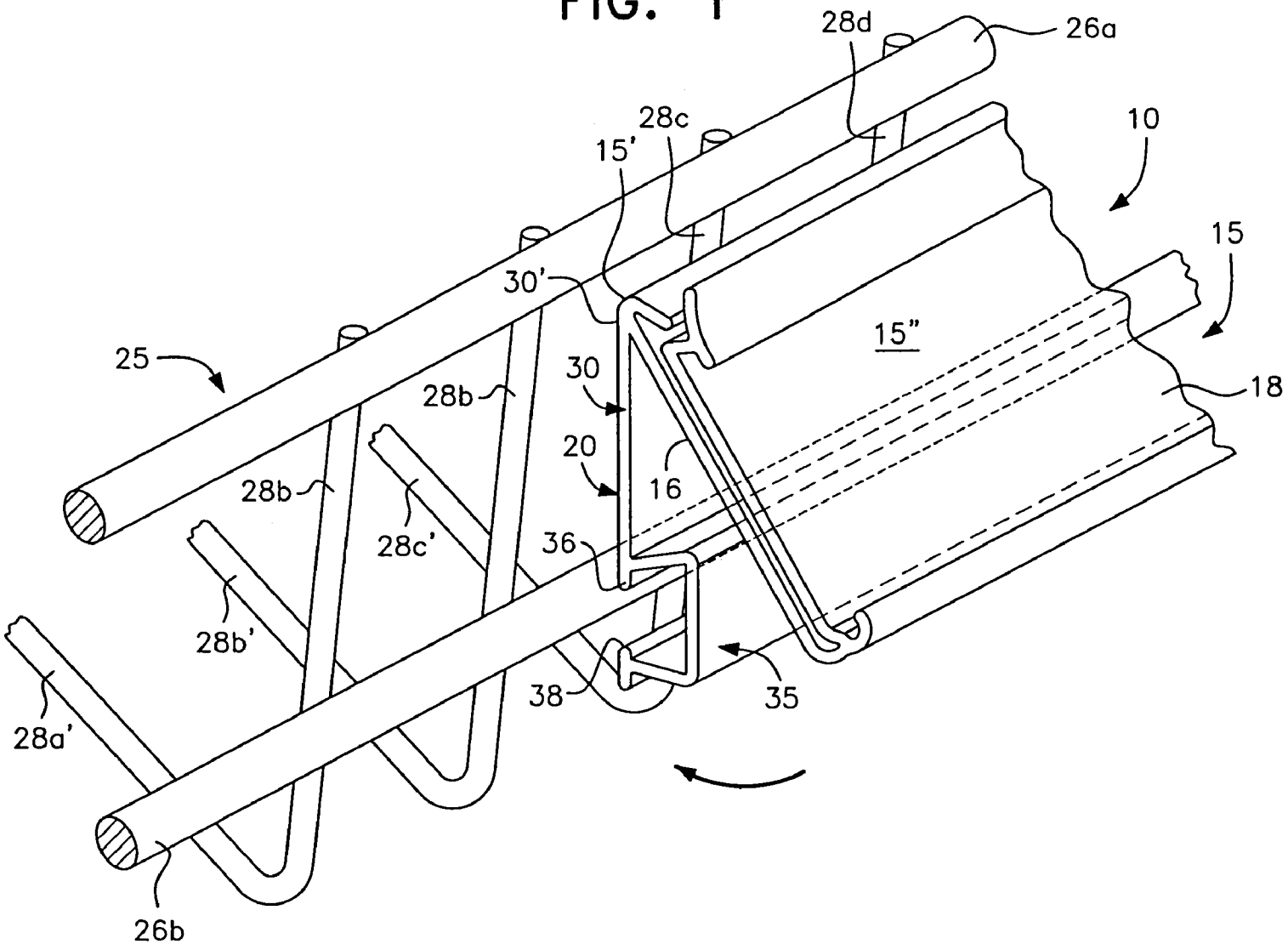
FIG. 1 is a fragmentary perspective view of one form of combination label/sign holder according to this invention showing the manner in which it would be snapped onto a generally horizontally-extending rod of a wire merchandise support.

In describing preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
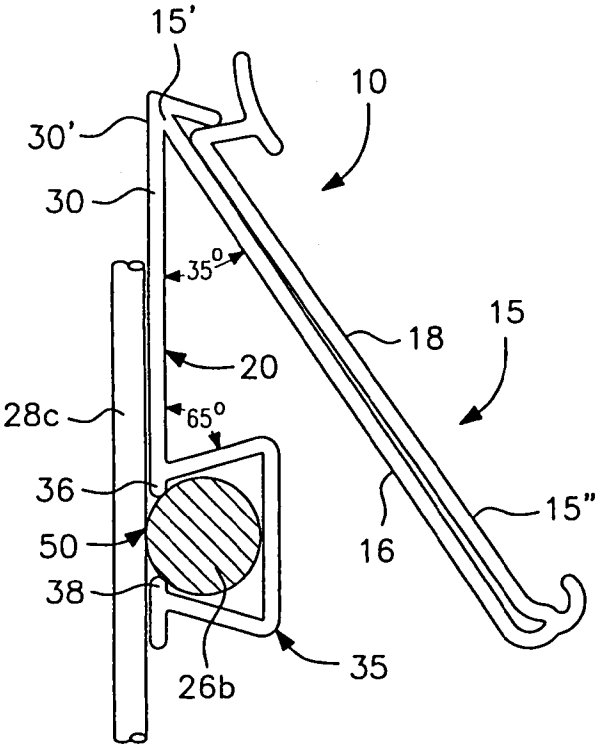
FIG. 2 is a fragmentary side view of the label holder of FIG. 1, partly in cross-section, showing the label holder in position supported by the wire rod.
Figure 5:
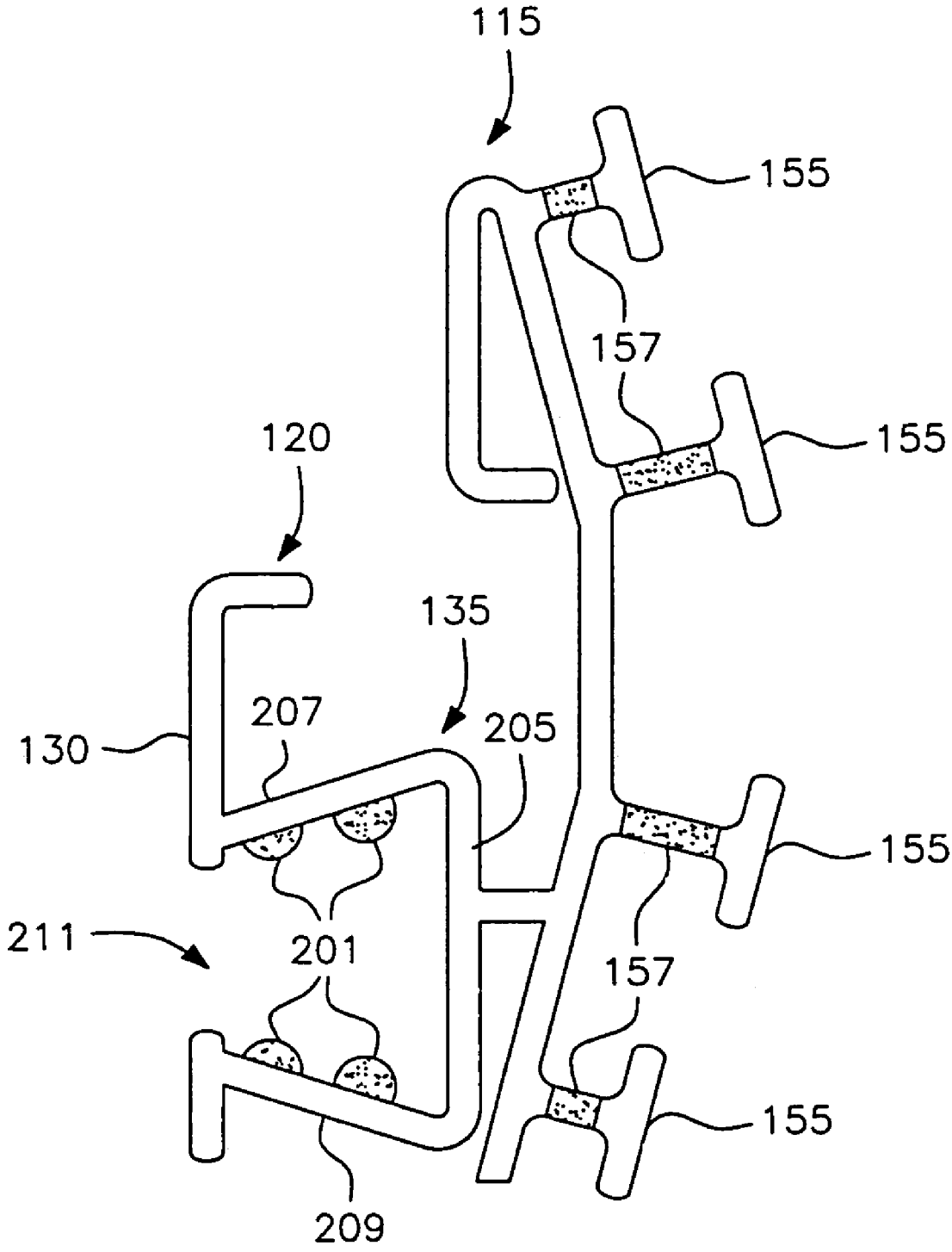
FIG. 5 is a side view similar to FIG. 2 showing a modified label holder for an ESL including flexible bumps or ridges within the trapezoidal interior.
Figure 6:
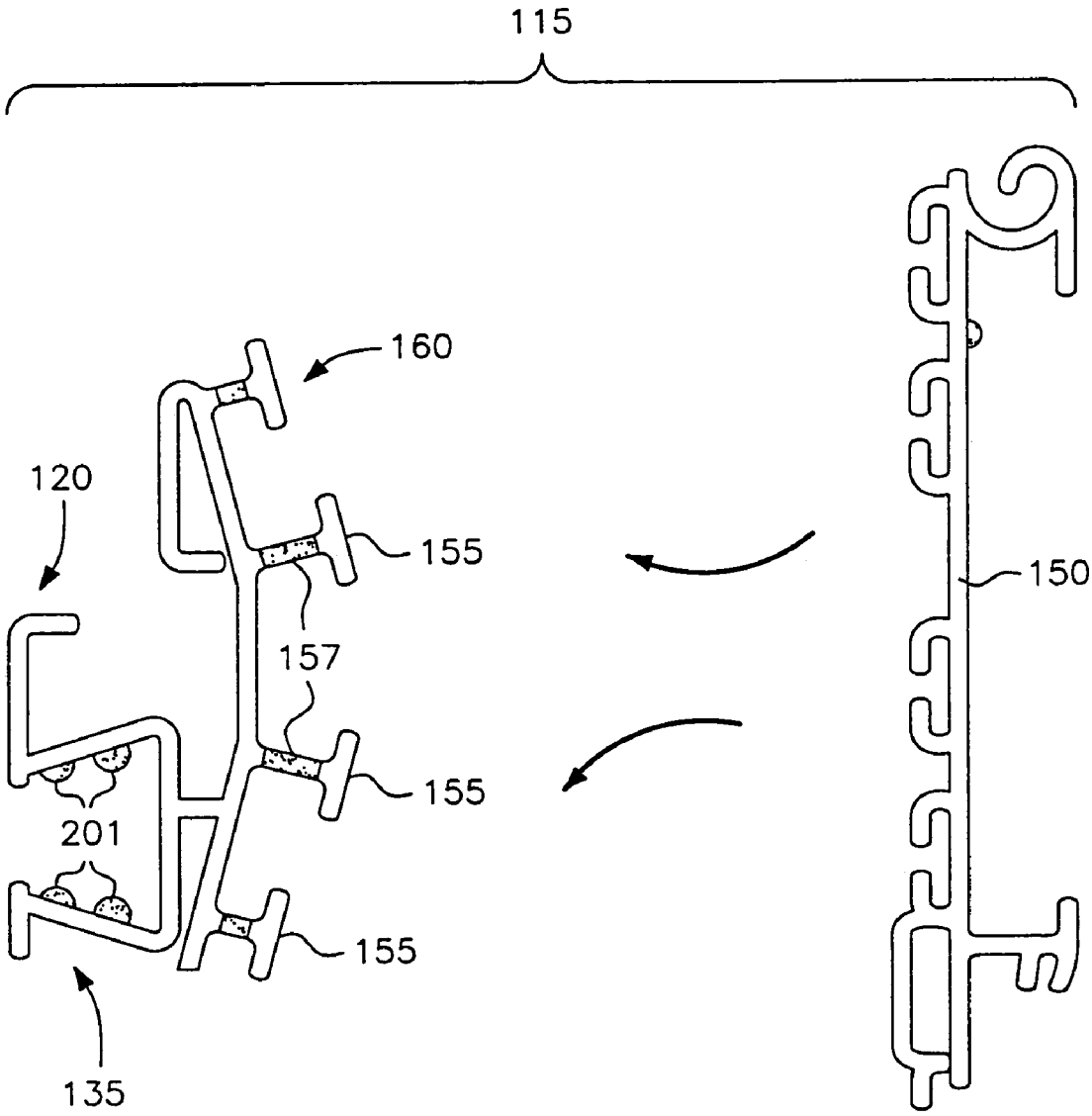
FIG. 6 is a side view of the modified label holder of FIG. 5 with an ESL holder member separated therefrom.

Referring now to the drawings, and more particularly to FIGS. 1 and 2, one embodiment of a combination label/sign holder according to this invention is designated generally by the reference numeral 10. The label/sign holder 10 is comprised basically of a label/sign holder portion 15 and the support portion 20.

The combination label/sign holder portion 15, except for the mounting means, is, for all intents and purposes, substantially identical to the product seen in the '112 patent to which reference may be made for details of its construction and use. As will be readily apparent from the following detailed description, other adhesive or non-adhesive, paper or plastic label holders or combination label/sign holders, or even electronic shelf label holders, can be readily substituted therefor.

Figure 7:
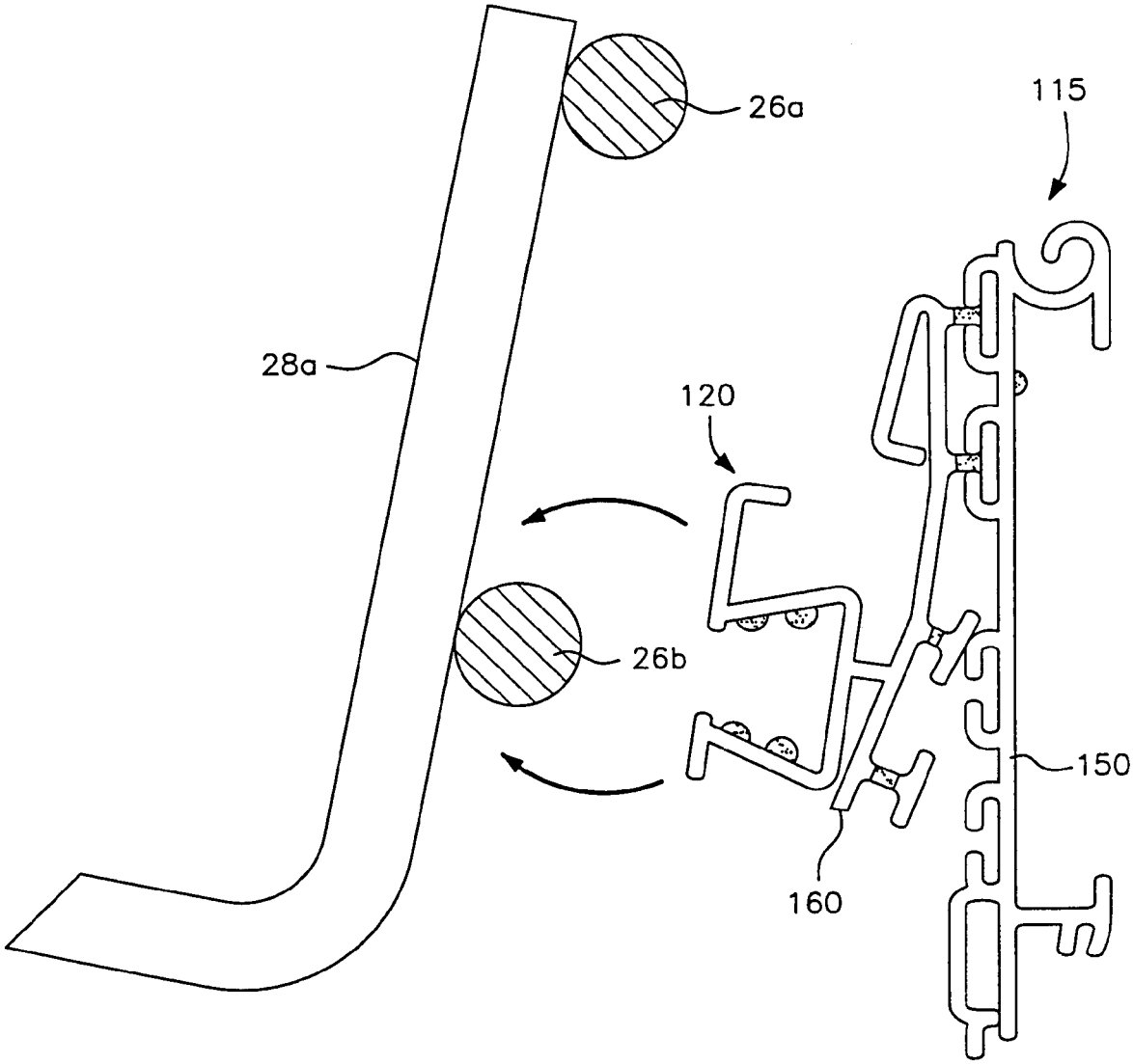
FIG. 7 shows an ESL holder with the mounting arrangement about to be secured to the horizontal rod.
Figure 8:
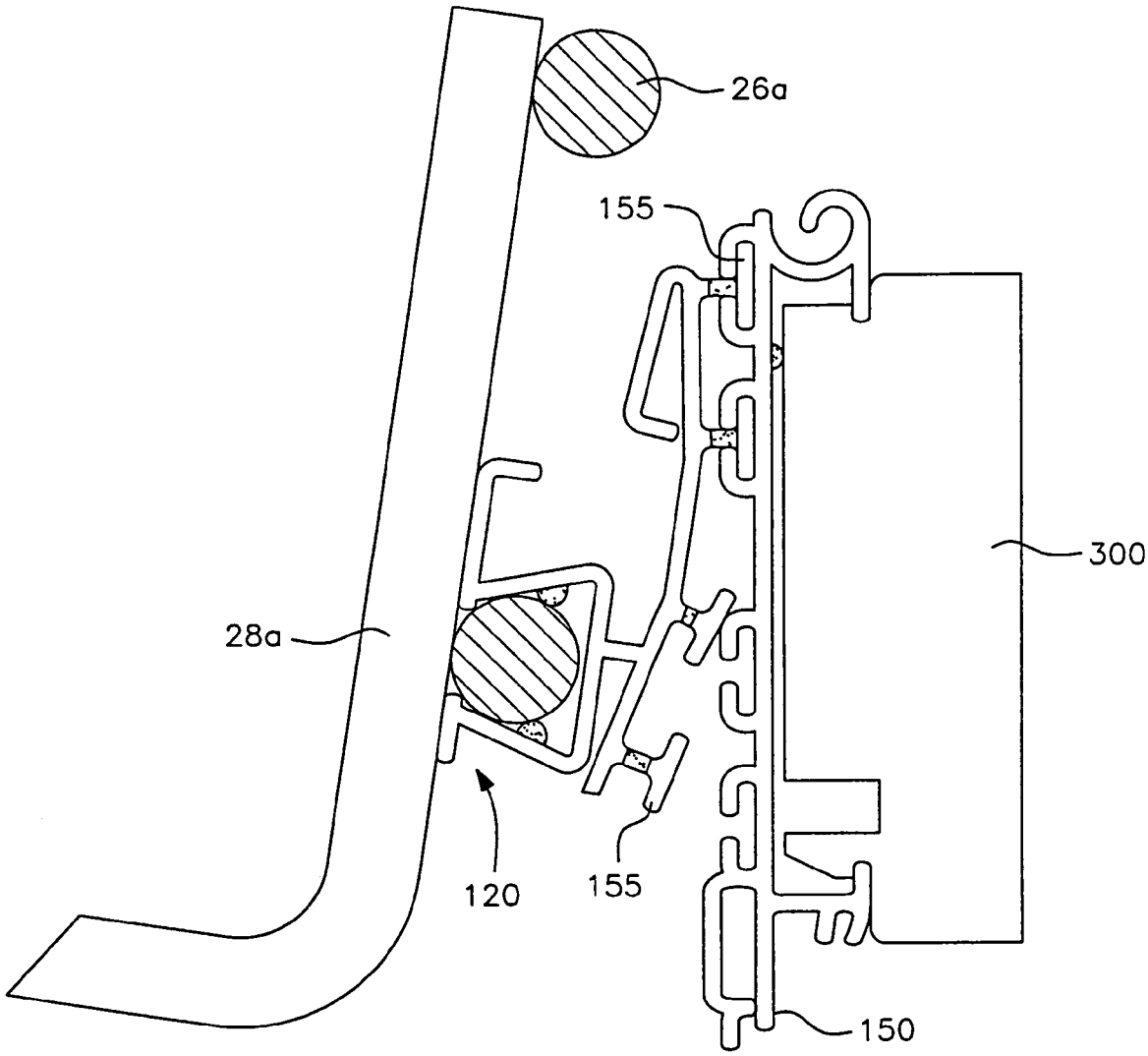
FIG. 8 shows the ESL holder secured to the horizontal rod.

The principal feature of the instant inventive concepts resides in the support portion 20 which is adapted to secure the label holder 10 to a wire rod merchandise support, such as a wire basket, a wire rack or shelf, or other such wire rod support units commonly found in supermarkets, drug stores and the like. Wire baskets, such as partially shown at 25 in FIG. 1, commonly have a plurality of generally horizontally-extending wire rods 26, two of which are shown at 26*a*, 26*b*, welded or otherwise secured at their points of contact to a plurality of spaced, generally vertically extending wire elements 28, four of which- are illustrated at 28*a*, 28*b*, 28*c* and 28*d*. The lower ends of the vertical wire elements 28 may have horizontally extending lower portions, such as shown at 28*a*', 28*b*', 28*c*, etc., to provide the basket 25 with a bottom. Although wire racks or shelves differ from wire baskets, in general, all such wire rod merchandise supports have both generally horizontally and vertically-extending wire rods or elements forming a grid-like structure. It should be understood that the vertical rods 28*a*, 28*b*, 28*c*, 28*d* may be angled forwardly, such as shown in FIGS. 7 and 8 and still be defined as vertical.

The support portion 20 of the label holder 10 of the instant invention comprises a generally planar backing element 30 and a generally trapezoidal-shaped snap-on connector 35. The backing element 30 may be on either or both ends of the connector 35.

One end 30' of the backing element 30 integrally supports one end 15' of the label holder portion 15 in a manner adapted to enable the label holder portion 15 to bypass the trapezoidal snap-on connector 35. In the embodiment of FIGS. 1 and 2, the connection is such as to provide the front surface 15" label portion 15 with an upwardly directed 350° angle in use, this embodiment having general utility, but being particularly designed for use with a relatively low, horizontally-extending, rod 26*b* on the display unit 25 to facilitate viewing of information on labels (not shown) carried by the label holder portion 15 when the viewer's eye is above the level of the label holder 10. For most purposes, this embodiment of the instant inventive concepts can be used anywhere on a wire rod merchandise support, including vertically extending wire rods if the labels are appropriately printed and it is mounted on the side of the display unit carrying the vertical wire rods.

Figure 3:
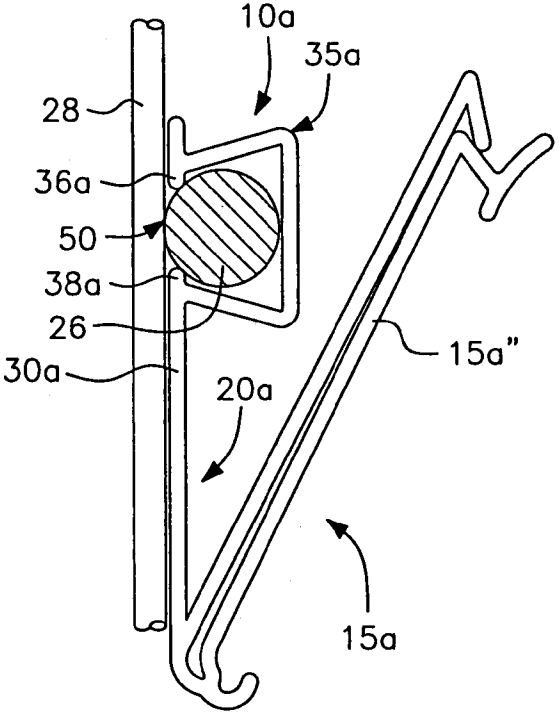
FIG. 3 is a view similar to FIG. 2, but illustrating a label holder modified to enable the same to be attached to a rod that is higher than the eye of a viewer.

If desired, the label holder 10 can simply be reversed (not shown) for attachment to a horizontally-extending rod of a wire support at a level higher than the eye of the viewer, particularly since the labels are captured in the pocket formed between the hingedly-secured label holder portion base element 16 and the cover 18. Alternatively, the label holder may be modified as seen in FIG. 3 wherein parts of the label holder 10*a*, similar to those of the label holder 10 of the embodiment of FIG. 1, are designated by the same reference characters followed by the suffix "a". In this embodiment, one end 30*a*' of the backing element 30*a* of the support portion 20*a* is attached to the opposite end 15*a*' of the label holder portion 15*a* for use on relatively high, generally horizontally-extending wire rods such as 26 to present the information carried by labels thereon at a downwardly directed angle.

Figure 4:
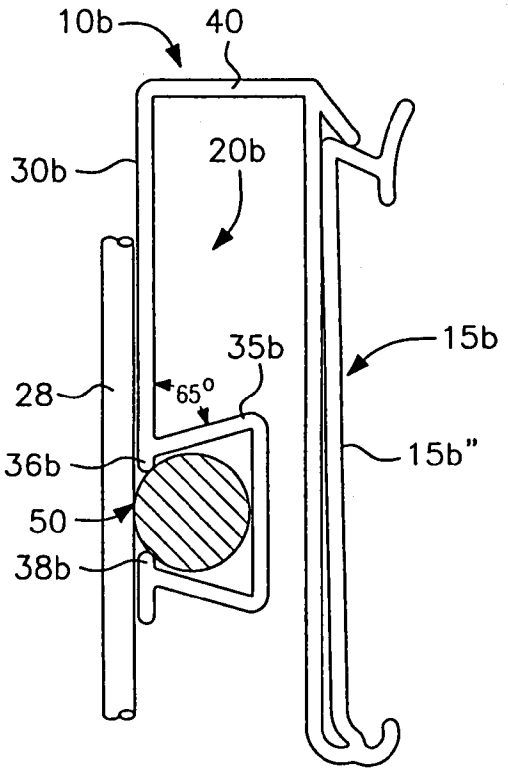
FIG. 4 is a view similar to FIG. 2 of a further modified label holder adapted to present merchandise information generally at the level of the eye of a viewer.

Finally, as seen in FIG. 4, wherein parts similar to the embodiment of FIG. 1 are designated by the same reference characters followed by the suffix "b", the support portion 20*b* of the label holder 10*b* may be attached to the label holder portion 15*b* by a connecting portion 40 to enable the label holder portion 15*b* to bypass the trapezoidal snap-on element 35*b* of the support portion 20*b* and to provide the label holder 10*b* with a generally vertically-extending orientation for applications when the same will be used at about the eye level of a viewer.

The trapezoidal snap-on connector 35 of the support portion 20 of the label holder 10 of this invention, as will be seen particularly in FIG. 2, is designed to resiliently snap over a horizontally-extending wire rod such as shown at 26. The connector 35 may include inwardly directed tabs 36, 38 at the inner ends of the trapezoidal portion to engage in the detents formed above and below the weld 50 connecting the horizontal wire rods 26 to the vertical rods 28. The planar element 30 of the support portion 20 is adapted to rest against the vertically-extending rods 28 to provide the support portion 20 with some rigidity in use.

Figure 1A:
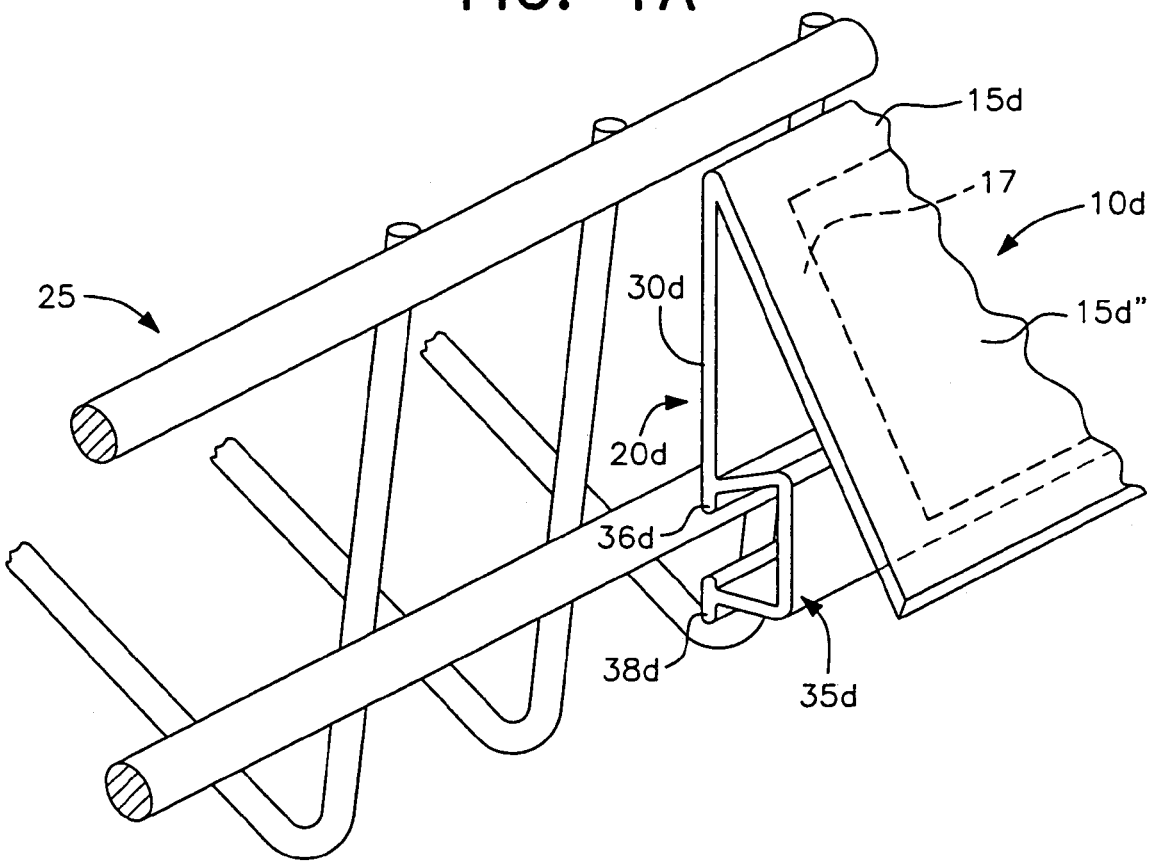
FIG. 1A is a view similar to FIG. 1 illustrating the unique mounting element of this invention supporting a simple panel for receiving an adhesive paper or plastic label.

It is also to be understood that, while a combination label/sign holder of the type seen in the '112 patent is illustrated in FIGS. 1-4, other label holder portions may be substituted therefor. For example, a simple planar panel 15*d* is illustrated in FIG. 1A wherein parts similar to those of the label holder of FIG. 1 are designated by the same reference characters followed by the suffix "d". The panel 15*d* is adapted to adhesively receive an adhesive paper or plastic label such as shown in dotted lines at 15".

Figure 1B:
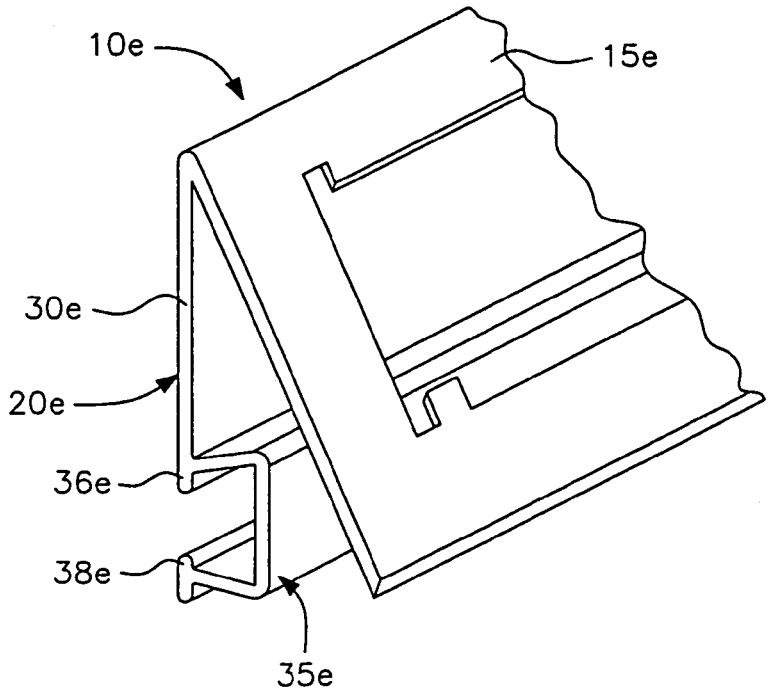
FIG. 1B is a fragmentary view of another embodiment of this invention illustrating an exemplary holder for an electronic shelf label.

Alternatively, an electronic shelf label (not shown) support portion 15*e* is illustratively shown in FIG. 1B wherein parts similar to the embodiment of FIG. 1 are designated by the same reference characters followed by the suffix "e". Details of this support portion can be seen in co-pending U.S. patent application Ser. No. 60/496,387 filed Aug. 20, 2003 (the '387 application), the subject matter of which is also incorporated herein in its entirety by reference. Other forms of ESL holders may obviously be substituted therefor without departing from the instant inventive concepts, as will be described.

The trapezoidal-shaped snap-on connector may be modified to include elongated bumps or ridges in the interior thereof. With reference to the ESL label holder embodiment depicted in FIGS. 5-8, the trapezoidal-shaped snap-on connector 135 is integrally-formed from a backing element 130 and is shaped similarly to the trapezoidal connector 35 of FIGS. 1-4. Within the interior of the trapezoidal-shaped connector 135 are a plurality of elongated parallel bumps or ridges 201 of flexible PVC material. These ridges are flexible with respect to the relatively rigid PVC material that forms the remaining portion of the trapezoidal-shaped connector 135. The trapezoidal-shaped connector 135 includes a trapezoid base 205 with a pair of non-parallel sides 207, 209 similar to the shape of the trapezoid of FIGS. 1-4. The backing element 130 defines an opening 211 formed on the side of the trapezoid parallel to the base 205. Thus, the base 205 is parallel to the backing element 130, although deviations from parallel may be permitted. This overall construction of the trapezoidal-shaped connector 135 is identical to that of the connector 35 of FIGS. 1-4. However, through the use of the flexible PVC bumps or ridges 201, the channel may be mounted to a variety of wire thicknesses since the flexible bumps assist in gripping the horizontal rods 26*b*, as shown in FIGS. 7 and 8. The plurality of the bumps 201 provides for a gripping force on the rod 26*b*. The bumps or ridges 201 may be circular in cross-section, with the pair of ridges closest to the base 205 being thicker than the ridges closest to the opening 211. The ridges 201 extend the entire length of the label holder, typically several feet in length.

Each of the embodiments of FIGS. 1-4 may include the flexible PVC bumps or ridges 201. In the embodiment of FIGS. 5-8, the label holder portion 115 is integral with the support portion 120, but is connected directly to the trapezoidal-shaped snap-on connector 135 at the base 205. It should be apparent that the label holders of FIGS. 1-4 may similarly be connected to the support portion 20 by direct connection to the base of the trapezoid.

The label holder portion 115, as depicted in FIGS. 5-8, is part of a label holder for an electronic shelf label and is described in commonly-assigned co-pending application Ser. No. 10/448,049 entitled "Label Holder for Electronic Labeling Devices" ("the '049 application"), incorporated by reference herein. As is described, the electronic shelf label ("ESL") 300 is retained by a holder member 150 which, in turn, is secured to T-shaped fingers 155 having a resilient or flexible stem portions 157 of an attachment portion 160. Selective interengagement of the holder 150 to T-shaped elements of the attachment element 160 enable the electronic shelf label to be positioned at different angles relative to the eye of the viewer, as is described in the '049 application. This label holder arrangement may also be utilized with the trapezoidal-shaped connector 35 without inclusion of the flexible bumps or ridges.

The label holder portion embodiments seen in FIGS. 1, 1A, 1B, and 5-8 are not intended to be limiting, but are only intended to illustrate the scope of the instant inventive concepts. Those skilled in the art can readily substitute other well known forms of label holders including those disclosed in the label holder patents identified above, and others.

The label holder of the instant invention may be formed of any suitable plastics material and in any fashion, although, from a practical standpoint, particularly considering the somewhat complex nature of the cross-section, it is preferred to extrude or co-extrude products of this nature from PVC according to well-known techniques.

The foregoing descriptions and drawings should be considered as illustrative only of the principles of the invention. As noted, the invention may be configured in a variety of shapes and sizes and is not limited by the dimensions of the preferred embodiment. Numerous applications of the present invention will readily occur to those skilled in the art. Therefore, it is not desired to limit the invention to the preferred embodiments or the exact construction and operation shown and described. Rather, all suitable modifications and equivalents may be resorted to falling within the scope of the invention.

The invention claimed is:

1. A label holder mountable on a wire merchandise support formed from a plurality of generally horizontally and vertically extending wire rods, the generally horizontal rods in contact with, and secured at the points of contact to, the generally vertical rods, with the horizontal rods overlying the vertical rods in facing relationship to the label holder, wherein said label holder includes a label holding portion for holding display labels and/or signs, and a support portion integral therewith for securing the label holder to the wire rod merchandise support, said support portion comprising a planar backing element and a generally trapezoidal-shaped snap-on connector formed from said backing element wherein one of the parallel sides of the trapezoid is coplanar with said backing element and defines an opening for receiving the horizontal rod and includes a pair of tabs adjacent said opening, said tabs engageable in a space between the horizontal and vertical rods and wherein the two non-parallel sides of the trapezoid are positioned to lie above and below the horizontal rod, said non-parallel sides forming acute angles with said backing element.

2. The label holder of claim 1 wherein said label holding portion is integrally connected with said planar backing element.

3. The label holder of claim 2 wherein said label holding portion lies substantially parallel with said backing element.

4. The label holder of claim 2 wherein said label holding portion forms an acute angle with said backing element.

5. The label holder of claim 4 wherein said label holding portion is angled to face upwardly.

6. The label holder of claim 4 wherein said label holding portion is angled to face downwardly.

7. The label holder of claim 1 wherein at least one of said non-parallel sides of the trapezoid includes flexible PVC bumps facing the trapezoid interior for engaging with the horizontal rod.

8. The label holder of claim 1 wherein each of said non-parallel sides of the trapezoid includes at least one elongated flexible PVC ridge.

9. The label holder of claim 1 wherein each of said non-parallel sides of the trapezoid include a pair of elongated flexible PVC ridges that face the trapezoid interior for engaging the horizontal rod.

10. The label holder of claim 1 wherein said label holding portion is integrally connected with said snap-on connector.

11. A label holder mountable on a wire merchandise support formed from a plurality of generally horizontally and vertically extending wire rods, the generally horizontal rods in contact with, and secured at the points of contact to, the generally vertical rods, with the horizontal rods overlying the vertical rods in facing relationship to the label holder, wherein said label holder includes a label holding portion for holding display labels and/or signs, and a support portion integral therewith for securing the label holder to the wire rod merchandise support, said support portion comprising a planar backing element and a generally trapezoidal-shaped snap-on connector formed from said backing element wherein one of the parallel sides of the trapezoid defines an opening for receiving the horizontal rod and the two non-parallel sides of the trapezoid are positioned to lie above and below the horizontal rod, wherein said planar backing element includes a rear planar surface for lying in contact with the vertical rods.

12. A label holder mountable on a wire merchandise support formed from a plurality of generally horizontally and vertically extending wire rods, the generally horizontal rods in contact with, and secured at the points of contact to, the generally vertical rods, wherein said label holder includes a label holding portion for holding display labels and/or signs, and a support portion integral therewith for securing the label holder to the wire rod merchandise support, said support portion comprising a planar backing element with a trapezoidal-shaped slot integral therewith, said trapezoidal-shaped slot including a planar base parallel to the planar backing element and joined to said planar backing element by a pair of side members forming acute angles with said base to define non-parallel sides of a trapezoid, each of said non-parallel sides include at least one flexible ridge facing the slot interior wherein said trapezoidal-shaped slot defines a snap-on connector for engaging the horizontal or vertical rods.

13. The label holder of claim 12 wherein said label holding portion comprises an electronic shelf label carrier having a holder member for gripping and supporting an electronic shelf label, and an attachment member for supporting said holder member, said attachment member including a plurality of T-shaped elements having a resilient stem portion.

* * * * *